US005361733A

United States Patent [19]

Spath et al.

[11] Patent Number: 5,361,733

[45] Date of Patent: Nov. 8, 1994

[54] COMPACT VALVE LIFTERS

[75] Inventors: Mark J. Spath, Spencerport; Timothy J. Peterson, Weedsport; Ivan R. Samalot, Rochester; Christopher M. De Minco, Honeoye Falls; Timothy W. Kunz, Rochester; Scott H. Nather, Churchville, all of N.Y.

[73] Assignee: General Motors Corporation, Detroit, Mich.

[21] Appl. No.: 11,667

[22] Filed: Jan. 28, 1993

[51] Int. Cl.[5] ..... F01L 1/34; F01L 1/24

[52] U.S. Cl. ..... 123/90.16; 123/90.5; 123/90.55

[58] Field of Search ..... 123/90.15, 90.16, 90.17, 123/90.27, 90.48, 90.52, 90.55, 90.49, 90.5

[56] References Cited

U.S. PATENT DOCUMENTS

| | | | |
|---|---|---|---|
| 3,277,874 | 10/1966 | Wagner . | |
| 4,335,685 | 6/1982 | Clouse | 123/90.5 |
| 4,708,102 | 11/1987 | Schmid | 123/90.35 |
| 4,905,639 | 3/1990 | Konno | 123/90.16 |
| 5,022,356 | 6/1991 | Morel, Jr. et al. | 123/90.5 |
| 5,070,827 | 12/1991 | Krieg et al. | 123/90.48 |
| 5,090,364 | 2/1992 | McCarroll et al. | 123/90.16 |
| 5,119,774 | 6/1992 | Krieg et al. | 123/90.55 |
| 5,129,373 | 7/1992 | Cuatt et al. | 123/90.55 |
| 5,186,130 | 2/1993 | Melchior | 123/90.5 |
| 5,188,067 | 2/1993 | Fontichiaro et al. | 123/90.5 |
| 5,189,997 | 1/1993 | Schneider | 123/90.16 |
| 5,193,496 | 3/1993 | Kruger | 123/90.16 |
| 5,253,621 | 10/1993 | Dopson et al. | 123/90.16 |
| 5,261,361 | 11/1993 | Speil | 123/90.5 |
| 5,287,830 | 2/1994 | Dopson et al. | 123/90.16 |

FOREIGN PATENT DOCUMENTS

| | | |
|---|---|---|
| 468202 | 1/1992 | European Pat. Off. . |
| 495260 | 7/1992 | European Pat. Off. . |
| WO91/12413 | 8/1991 | WIPO . |
| WO9210650 | 10/1992 | WIPO . |

*Primary Examiner*—E. Rollins Cross
*Assistant Examiner*—Weilun Lo
*Attorney, Agent, or Firm*—Charles K. Veenstra

[57] ABSTRACT

Compact valve lifters are disclosed for overhead camshaft engines with direct acting valve gear and for engines with indirect acting valve actuation such as push rod actuated overhead valves. Two step variable lift and non-variable lift valve lifters are included as are roller and non-roller follower types with various features in common.

7 Claims, 10 Drawing Sheets

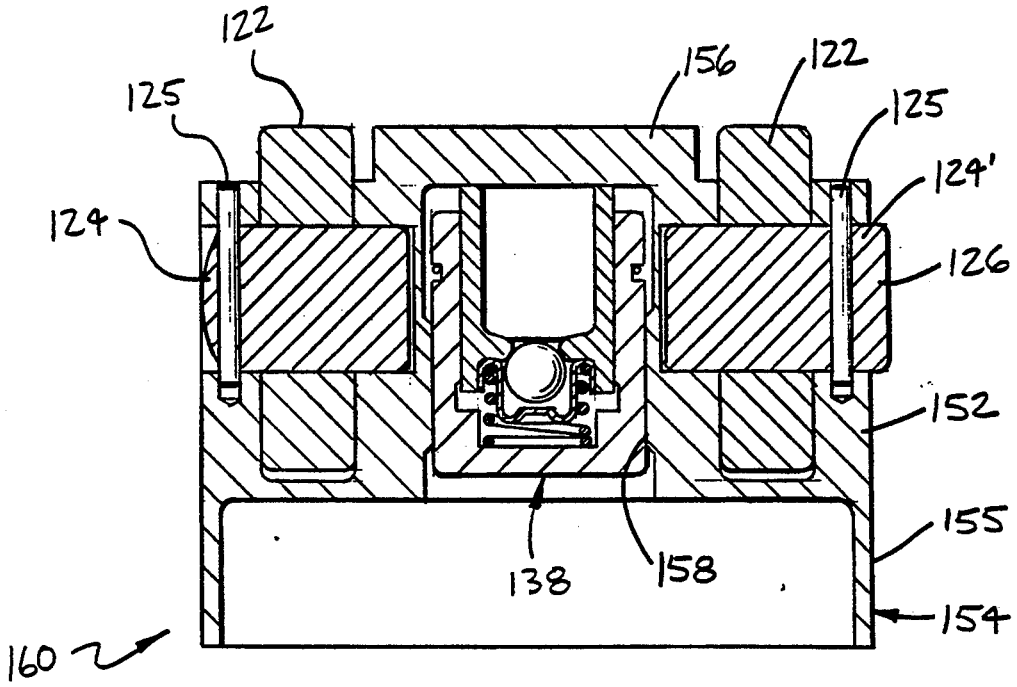
FIG-8
FIG-9
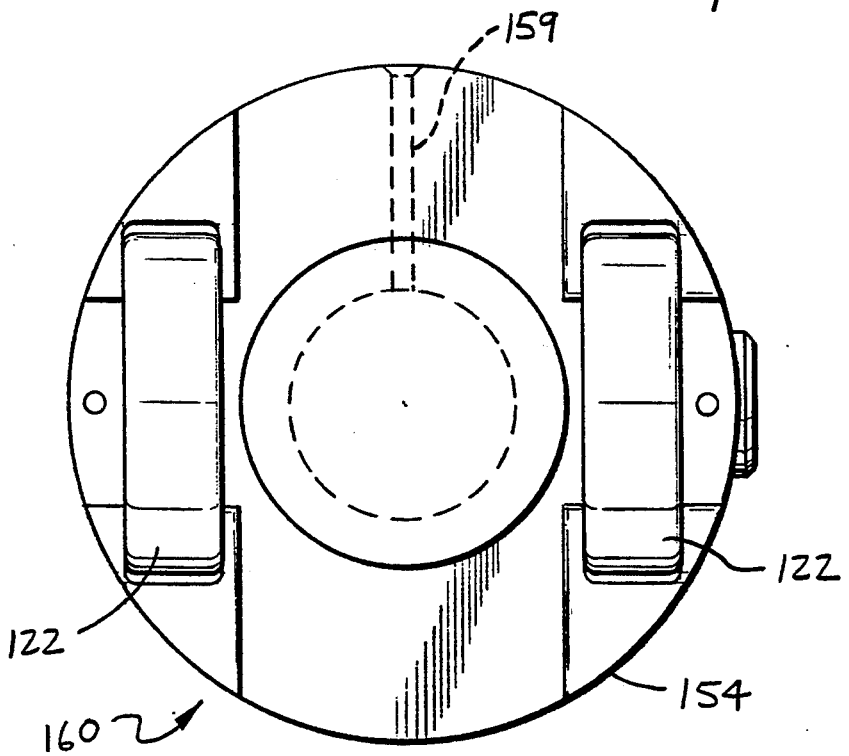

COMPACT VALVE LIFTERS

TECHNICAL FIELD

This invention relates to valve lifters for internal combustion engines and the like. In particular, the invention relates to cam actuated variable and non-variable lift, roller and non-roller type compact lifters of both direct and non-direct acting types for overhead, in-head and in-block camshaft engines.

BACKGROUND

PCT international patent application publication WO91/12413 (Lotus) published 22 Aug. 1991 discloses valve lift control devices of various forms which provide variable valve lift. In one embodiment, a lifter has a cylindrical high lift outer cam follower that engages a pair of spaced cams for high lift valve actuation and a low lift inner cam follower that engages a central low lift cam directly or through an intermediate follower member for low lift valve actuation.

The inner follower is reciprocable in a bore of the outer follower and directly actuates the valve through a hydraulic lash adjuster. The outer follower is reciprocable in a bore of an associated engine component and is selectively connectable to the inner follower by locking means. These, when engaged, cause the inner follower to move with the outer follower, thereby actuating the valve in a high lift motion determined by the profiles of the high lift cams.

SUMMARY OF THE INVENTION

The present invention involves novel combinations of elements based in part on the teachings of publication WO91/12413 but having various modifications and improvements which provide various additional features and advantages.

In a first embodiment, the invention provides an indirect acting two step variable hydraulic valve lifter for push rod or rocker actuation. Additional features include conventional lash adjuster arrangement for cam in block valve mechanism, modified locking and rotational alignment of followers and rotation enhancing means.

In a second embodiment, the invention also provides rollers for inner and outer cam followers similar to the first embodiment.

In a third embodiment, the invention provides a direct acting two step variable hydraulic valve lifter having roller followers for the high lift cams while retaining a compact configuration for the valve lifter assembly.

In a fourth embodiment, the invention provides a direct acting one step non-variable hydraulic valve lifter having roller followers integrated in a compact configuration based upon the third embodiment.

These and other features and advantages of the invention will be more fully understood from the following description of certain specific embodiments of the invention taken together with the accompanying drawings.

BRIEF DRAWING DESCRIPTION

Figure 4A:
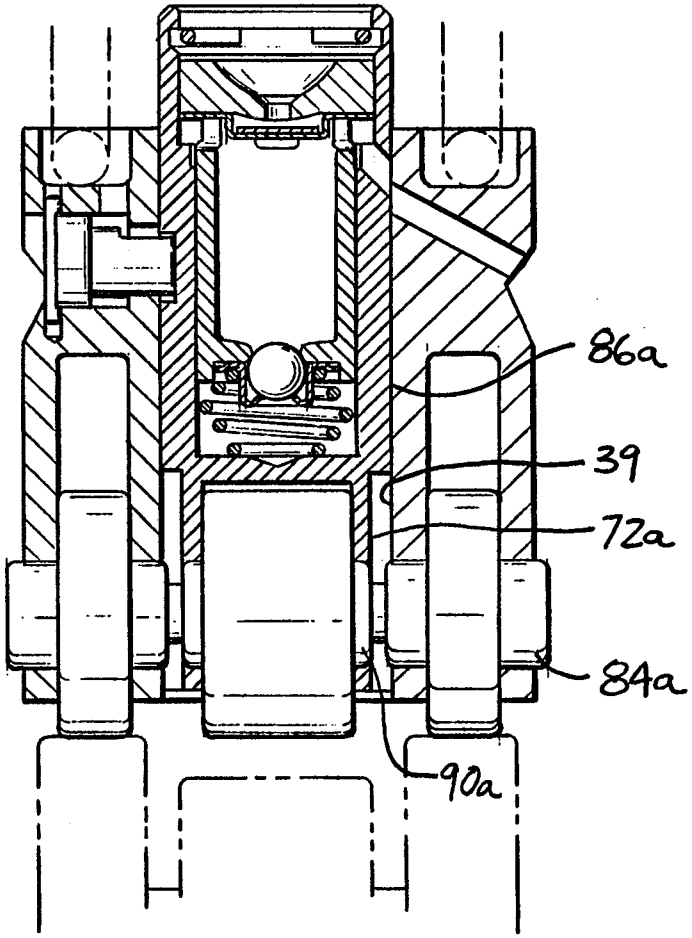
FIG. 4 is a cross-sectional view similar to FIG. 3 but showing a second embodiment of indirect acting valve mechanism and valve lifter according to the invention.
Figure 4:
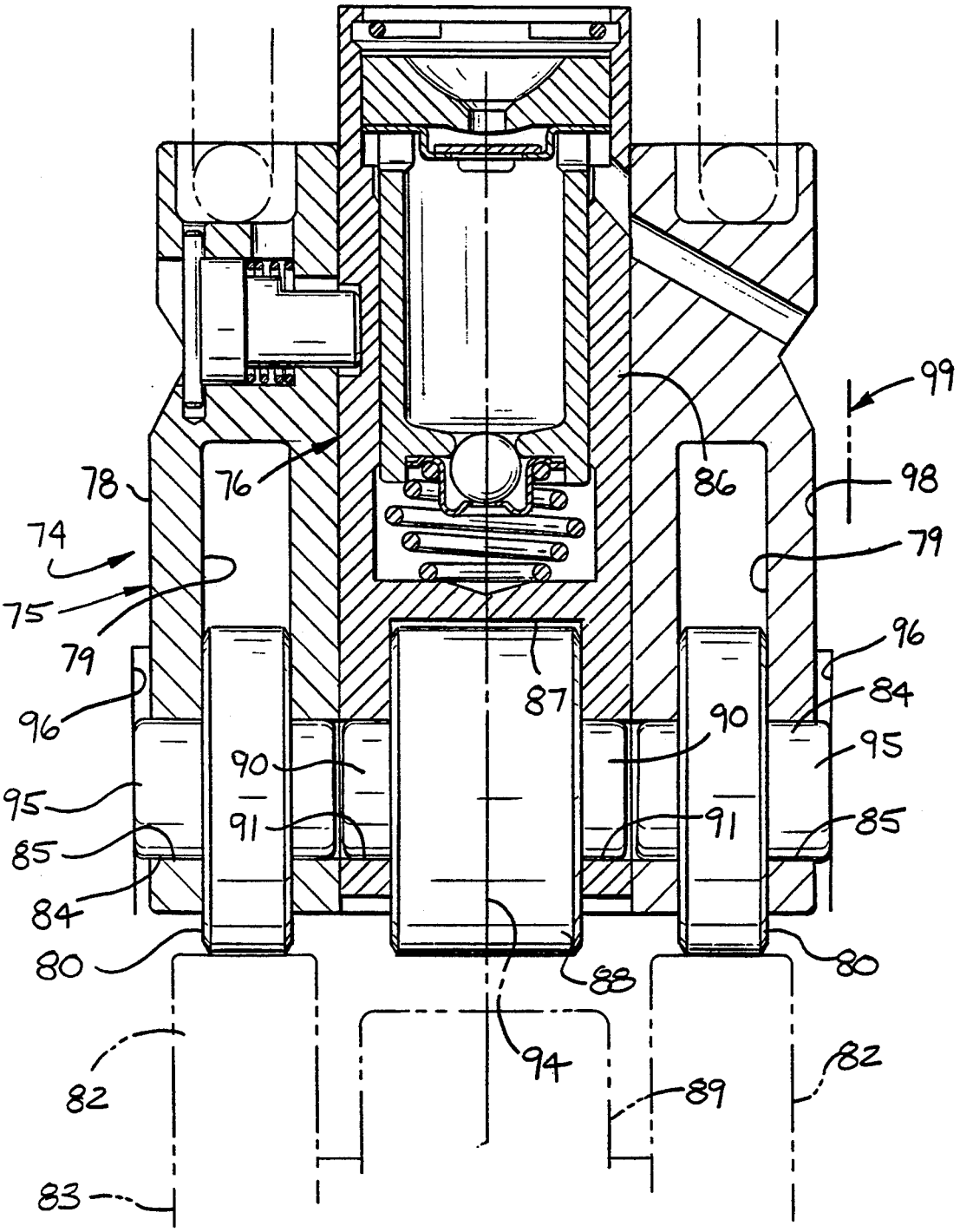
Figure 5:
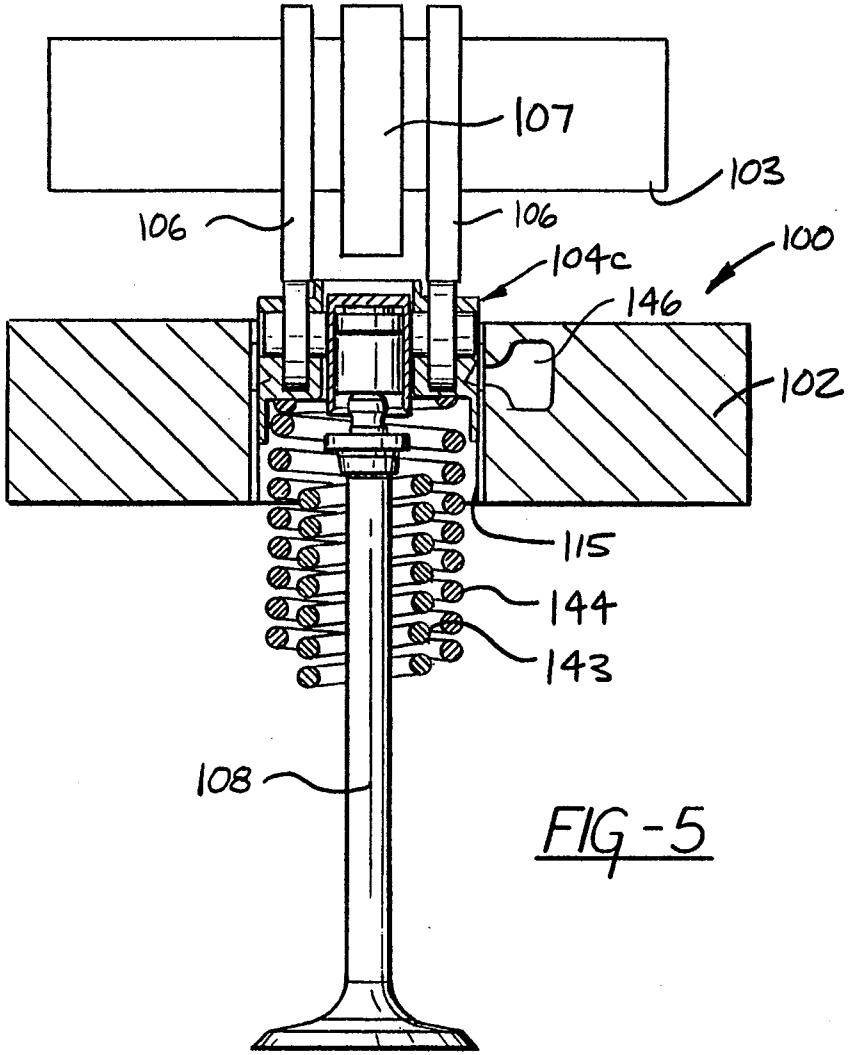
Figure 4B:
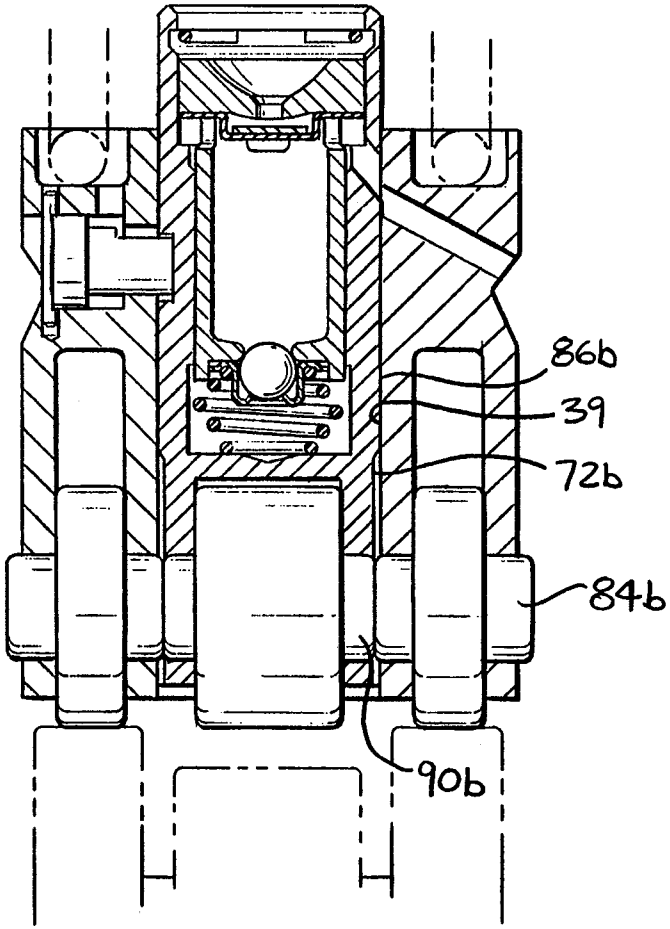
Figure 5A:
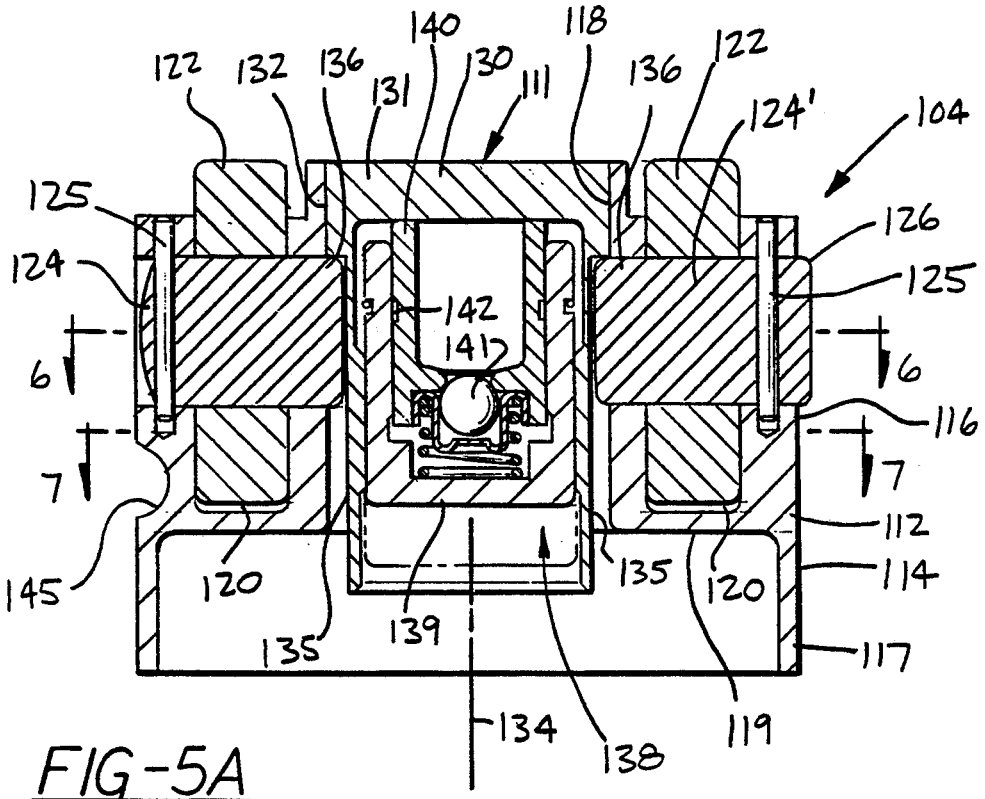
Figure 5B:
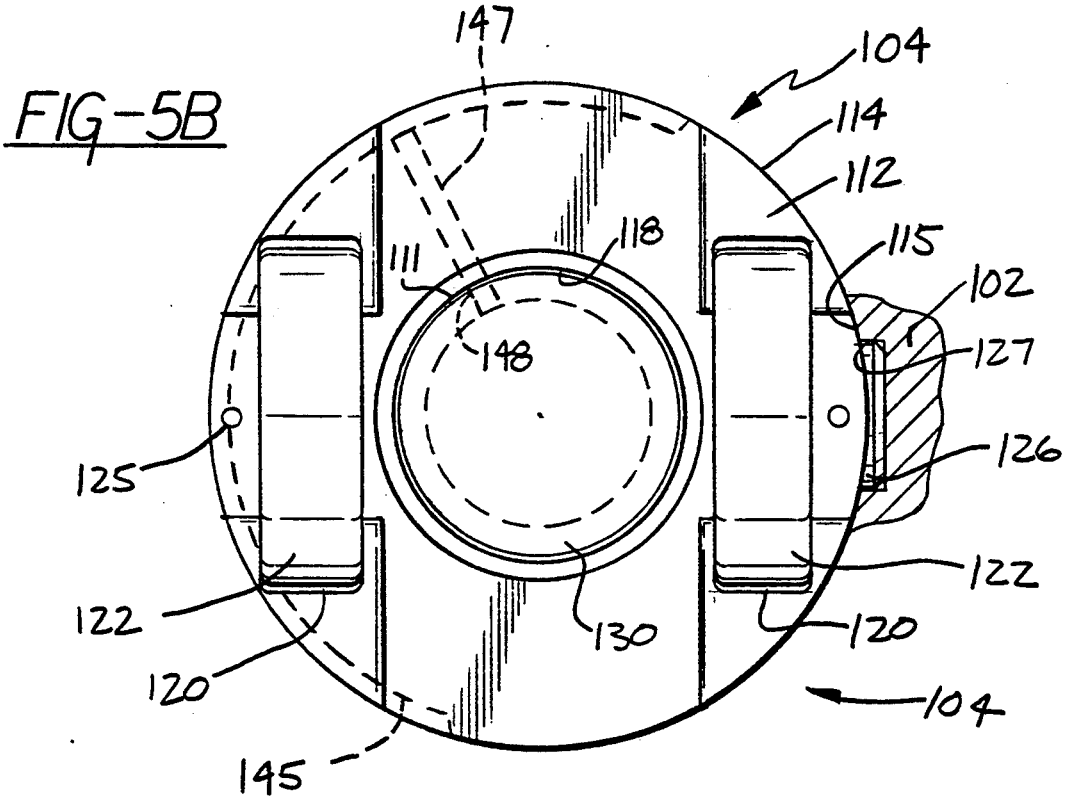

FIGS. 4*a* and 4*b* are views similar to and showing variations of the embodiment of FIG. 4;

FIG. 5 is a partially schematic cross-sectional view of an engine having direct acting valve mechanism with a variable lift direct acting valve lifter comprising a third embodiment according to the invention;

FIG. 5*a* is an enlarged cross-sectional view of a variable lift direct acting valve lifter similar to that of FIG. 5;

FIG. 5*b* is a top view of the lifter of FIG. 5*a;*

Figure 6:
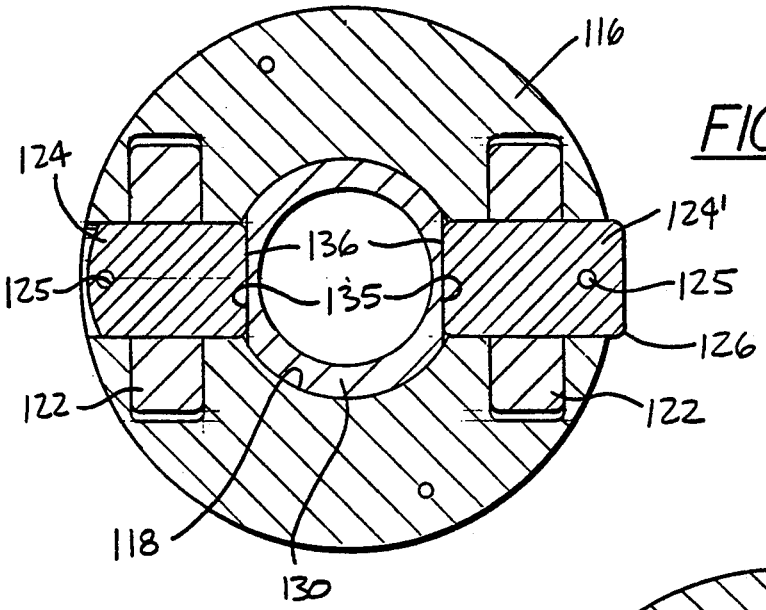

FIG. 6 is a cross-sectional view across the axis of the direct acting valve lifter from the line 6—6 of FIG. 5*a;*

Figure 6A:
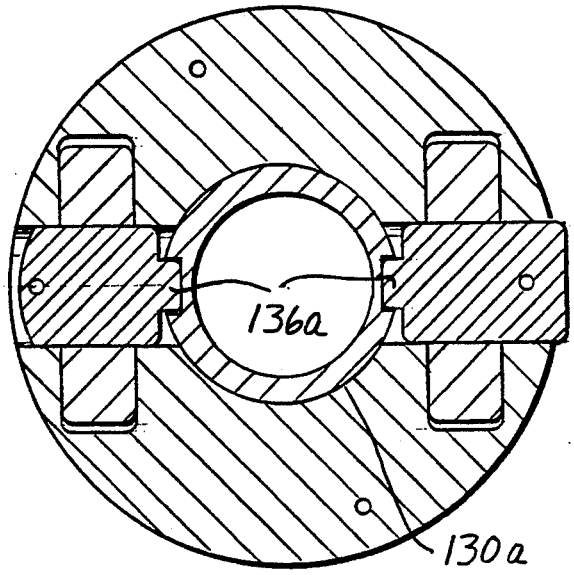
Figure 6B:
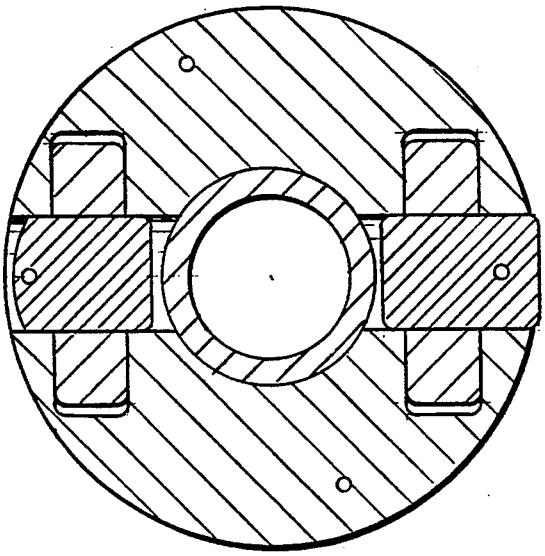
Figure 7:
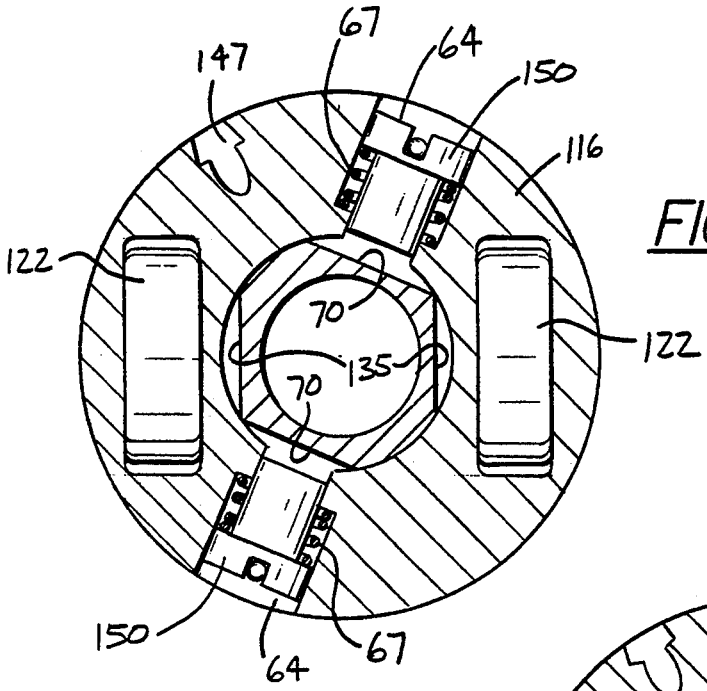

FIGS. 6*a* and 6*b* are views similar to and showing variations of the embodiment of FIG. 6;

FIG. 7 is a cross-sectional view from the line 7—7 of FIG. 5*a;*

Figure 7A:
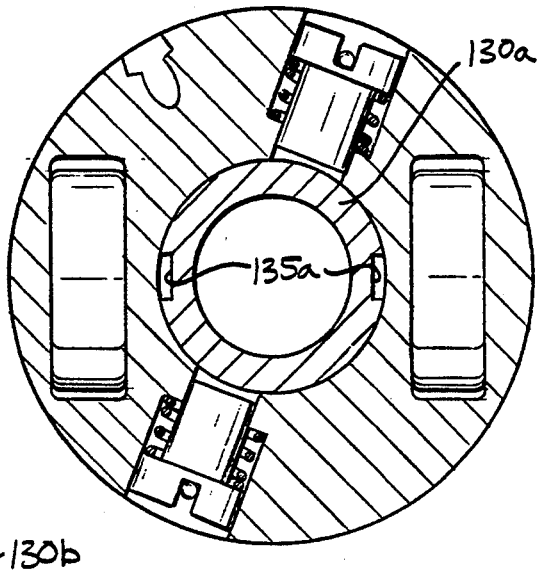
Figure 7B:
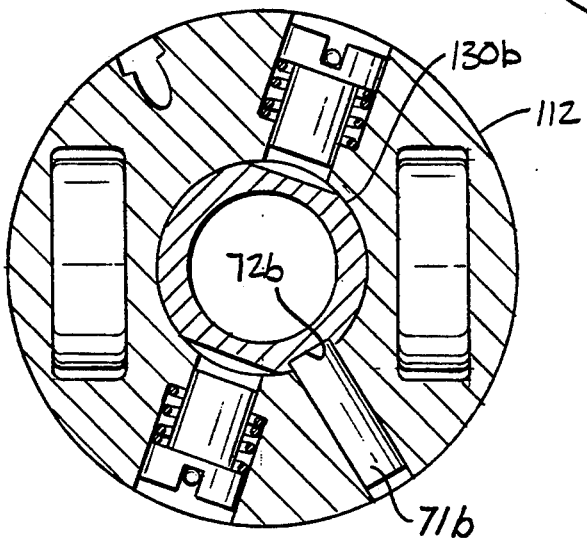
Figure 10:
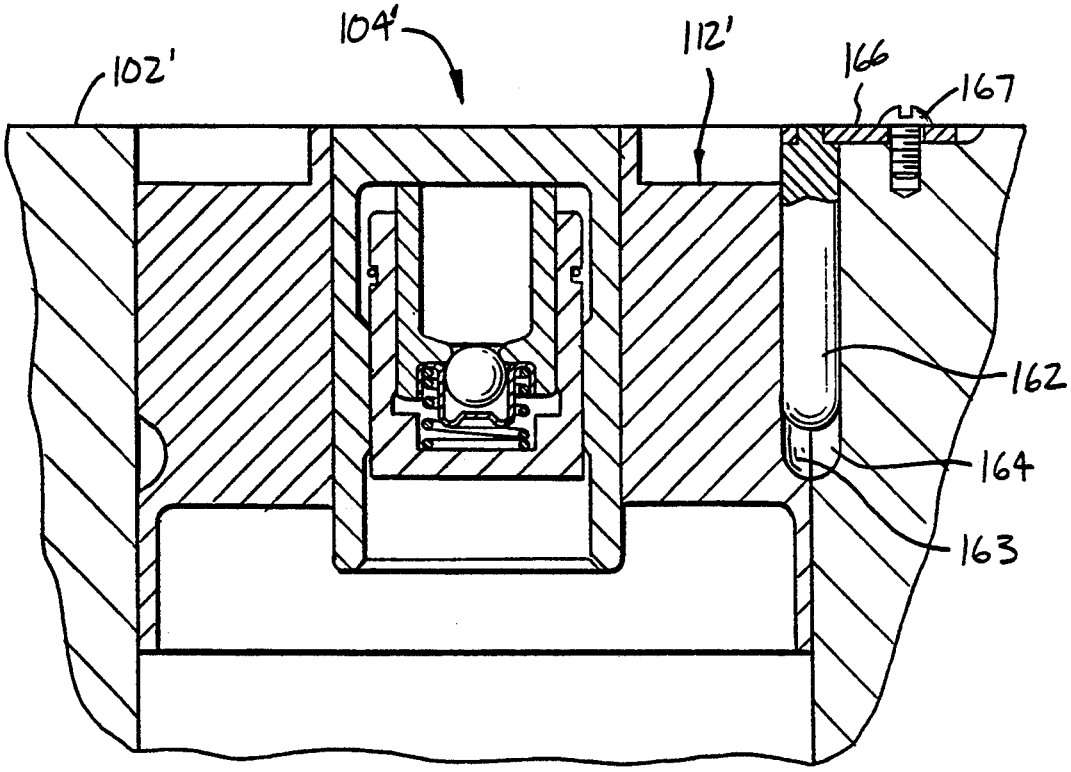
Figure 11:
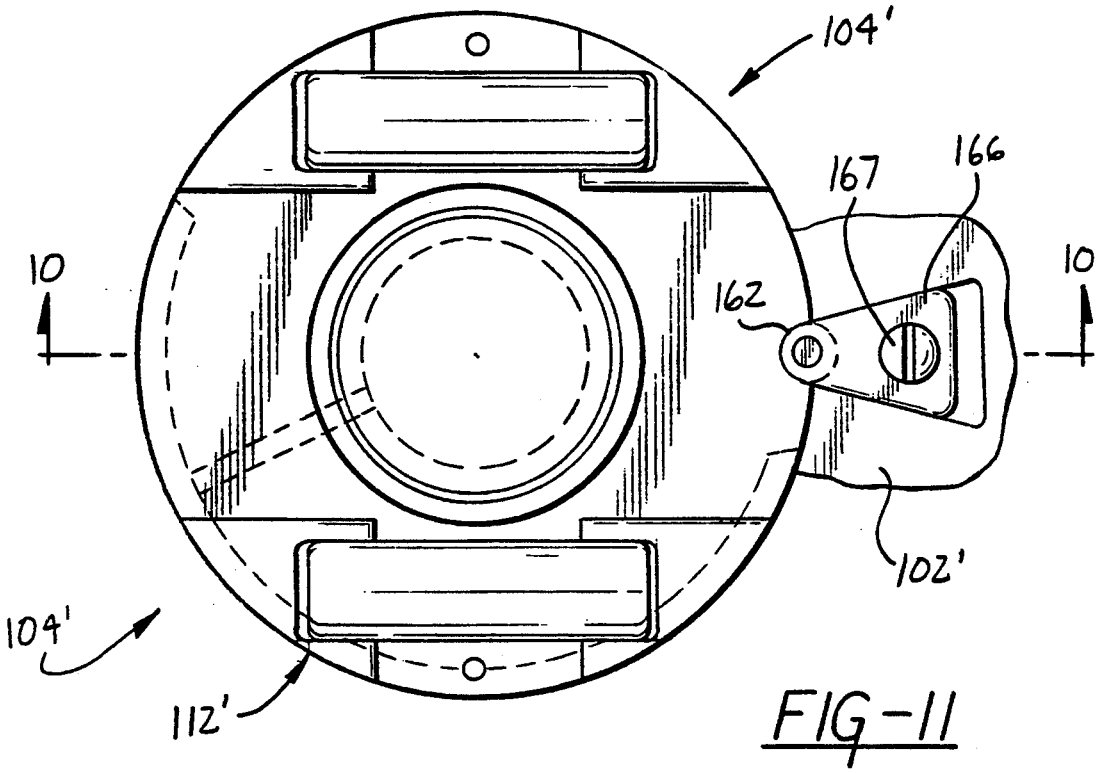

FIGS. 7*a* and 7*b* are views similar to and showing variations of the embodiment of FIG. 7;

FIG. 8 is a cross-sectional view similar to FIG. 5*a* but showing a fourth embodiment comprising a non-variable direct acting valve lifter according to the invention;

FIG. 9 is a top view of the lifter of FIG. 8 showing relative locations of the rollers and oil feed hole;

FIG. 10 is a cross-sectional view from the line 10—10 of FIG. 11 showing an engine with valve lifters similar to FIGS. 5*a* and 5*b* but with an axial pin variation of the anti-rotation means; and FIG. 11 is a top view of the lifter variation of FIG. 10.

DETAILED DESCRIPTION

First Embodiment—VHVL

Figure 1:
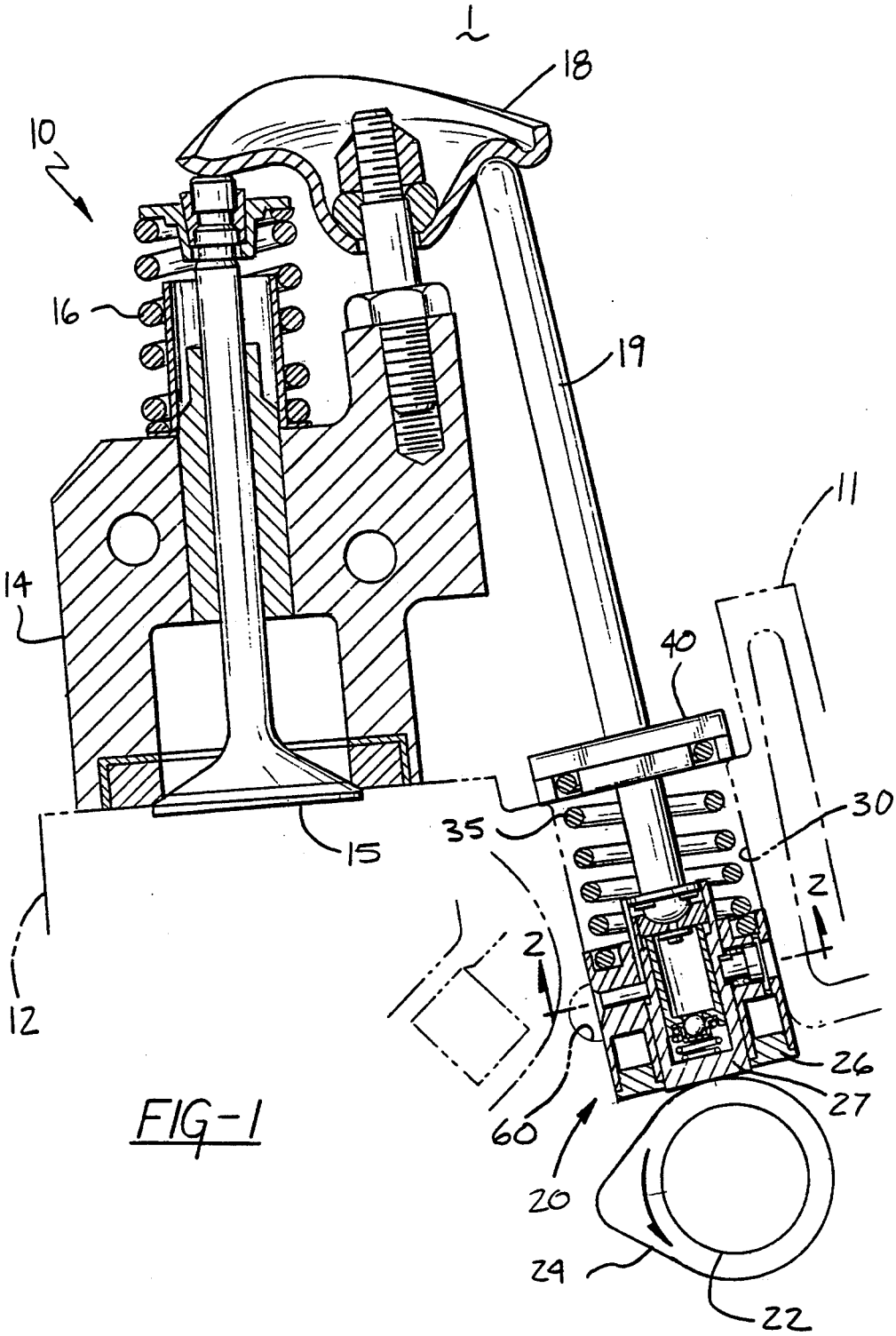
FIG. 1 is a transverse cross-sectional partially schematic view of an engine with indirect acting valve mechanism having a first embodiment of valve lifter in accordance with the invention.
Figure 2:
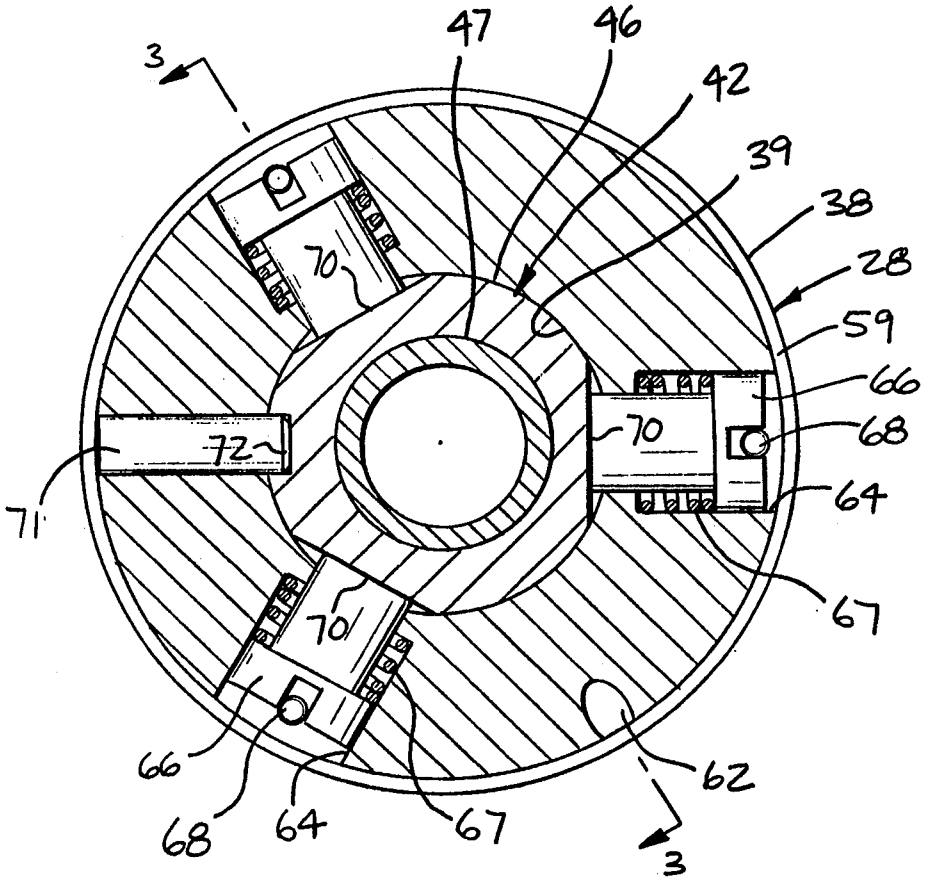
FIG. 2 is a cross-sectional view across the axis of the lifter from the line 2—2 of FIG. 1.
Figure 3:
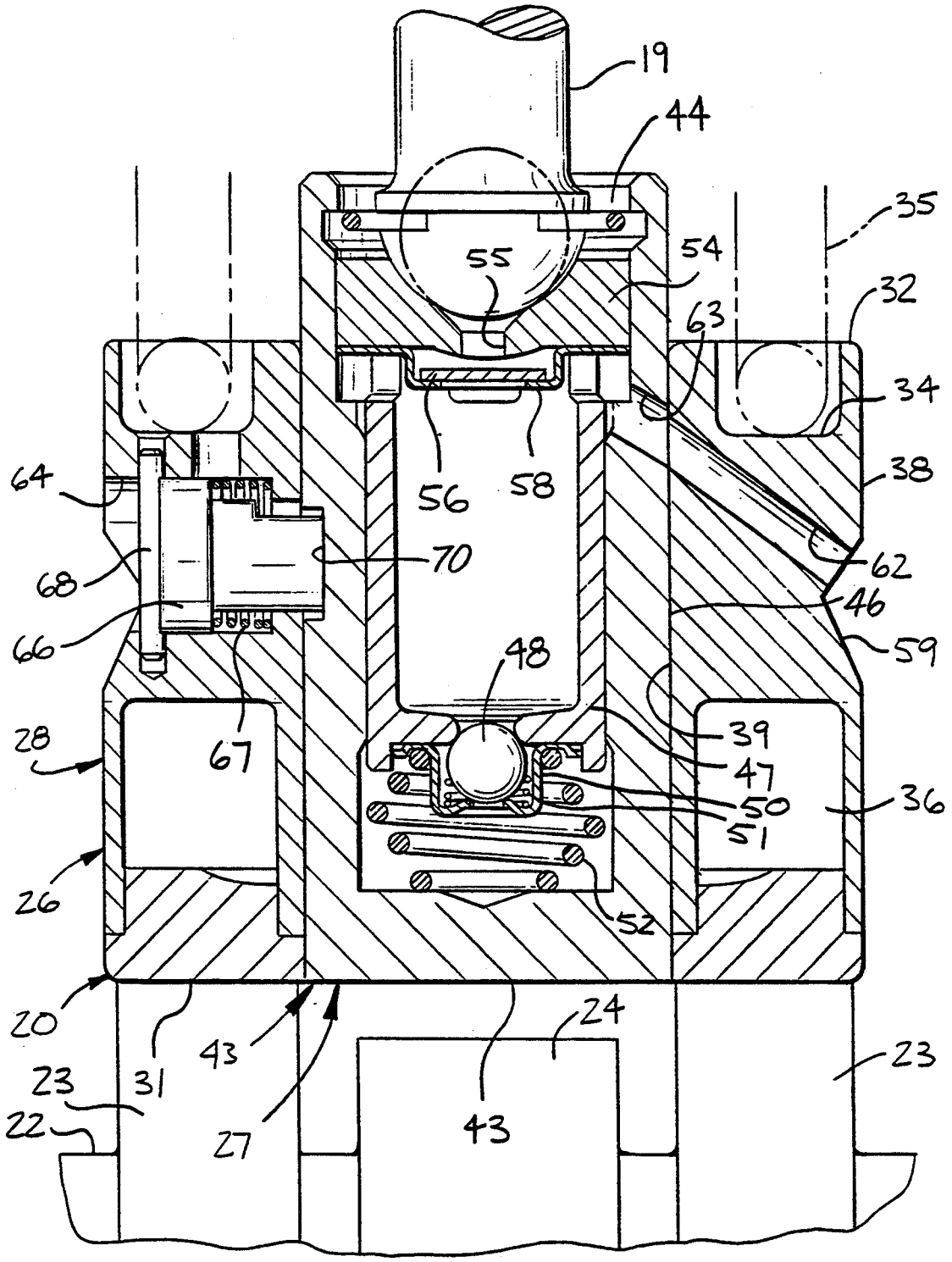
FIG. 3 is a cross-sectional view along the axis of the lifter associated portion of the valve train from the line 3—3 of FIG. 2 but shown with a different camshaft rotational position.

Referring now to FIGS. 1–3 of the drawings in detail, numeral 10 generally indicates an overhead valve cam in block reciprocating piston engine having push rod/-rocker arm type valve gear and showing one embodiment of the invention. The engine includes a cylinder block 11 having at least one cylinder 12 closed by a cylinder head 14. The cylinder head carries at least one inlet valve 15 and one exhaust valve, not shown, controlling ports connecting with the cylinder. Each valve is biased closed by a spring 16 and is opened by valve gear or mechanism such as a rocker arm 18 actuated by a push rod 19, a valve lifter 20 and an associated camshaft 22.

The exhaust valves may be actuated by conventional devices or by lifters in accordance with the present invention, but in the illustrated example, the lifter for each inlet valve 15 is a two step variable hydraulic valve lifter (VHVL) 20 selectively actuated by a pair of spaced high lift cams 23 and a central low lift cam 24 located on the camshaft 22 between the high lift cams 23. The lifter 20 includes a high lift outer cam follower 26 actuated by the high lift cams 23 and a low lift inner cam follower 27 actuated by the low lift cam 24.

The outer follower 26 has a cylindrical annular body 28 that is reciprocable in a lifter bore 30 of the engine block. A first annular end 31 of the body engages the high lift cams while an opposite second annular end 32 includes a recess 34 in which a return spring 35 is seated. The first end 31 is preferably made as a separate plug that closes the open end of an annular hollow portion 36 of the body 28. This minimizes the mass and allows the body to be made of a different hardness or material than the end plug 31 which engages the cams. The body 28 also has a cylindrical outer surface 38 received in the lifter bore 30 and a concentric cylindrical inner surface 39. The spring 35 preferably seats upwardly against a rotator bearing 40 which is mounted in the engine block 11 and facilitates rotation of the lifter 20, which is desirable for low wear.

The low lift inner follower 27 is formed much like a conventional valve lifter although of smaller diameter than those now in common use. It includes a hollow piston 42 with a closed end 43, an open end 44 and a cylindrical wall 46 reciprocably engaging the cylindrical inner surface 39 of the body 28. The closed end 43 selectively engages the central low lift cam 24 of the camshaft. Follower 27 further includes hydraulic lash adjusting elements including a plunger 47, check ball 48, ball cage 50, ball spring 51 and plunger spring 52. A push rod seat 54 mounts against the plunger 47 in a counterbore in the open end 44 of the piston 27. Lubricating oil flow to the push rod and rocker arm through an orifice 55 in the seat 54 is controlled by a metering disk 56 retained by a retainer 58 in known manner. These features are found in many production valve lifters.

An annular oil groove 59 around the body 28 connects with a pressure oil gallery 60 in the engine block. Connecting oil passages 62, 63 in the body 28 and piston wall 46, respectively, feed oil from the groove 59 through slots in the plunger 47 to the lash adjuster and to the hollow push rod 19 for lubricating the rocker arm 18. Radial openings 64 in the body receive headed lock pins 66 biased outward by springs 67. Retaining pins 68 hold the lock pins in the body. Flats 70 or other suitable recesses are provided on the piston for engagement by the lock pins when forced inward. To prevent relative rotation of the body 28 and piston 42 and maintain the lock pins 66 and flats 70 in alignment, alignment means are provided such as a guide pin 71 fixed in the body 28 and engaging a guide groove 72 in the piston 42.

In operation, pressure control means, not shown, are provided to selectively control the oil pressure in the oil gallery 60 to vary the valve lift between low and high lift functions and provide adequate oil pressure for hydraulic lash adjuster operation. With low pressure, the lock pins 66 are retracted and the inner and outer cam followers 27, 26 are disengaged. Thus, the inner follower, 27 engages and is controlled by the central cam 24 to move the valve in a low lift motion and the outer follower 26 idles by moving with the high lift cams 23 but without any connection with or effect upon the valve motion.

Increasing the oil pressure by the control means causes the lock pins to move inward and, when the cam followers are on the cam base circles, engage the flats 70 to lock the inner and outer followers together as shown in the drawings. The inner follower 27 thus moves with the outer follower 26 along the high lift curve established by the high lift cams 23 and the valve 15 is moved in a corresponding high lift motion.

Second Embodiment—RVHVL

FIG. 4 illustrates another embodiment of engine with push rod type valve gear in which each intake valve is actuated by an indirect acting roller variable hydraulic valve lifter (RVHVL) 74 according to the invention. As shown, in the illustrated embodiment, the lubricating, lash adjusting, locking and alignment features of lifter 74 are the same as or similar to those of the first described valve lifter 20 so their description will not be repeated and, where needed, like numerals indicate like parts.

The outer cam follower 75 and inner cam follower 76 differ from the first embodiment in the provision of cam engaging follower rollers. The annular body 78 of the outer cam follower 75 is extended to carry in slots or recesses 79 a pair of spaced rollers 80 engaging spaced high lift cams 82 of the camshaft 83. The rollers 80 may ride on bearings, such as needles, not shown, which are carried on axle pins 84 received in transverse bores 85 in the body 78. Similarly, the hollow piston 86 of the inner cam follower 76 is extended to carry in a recess 87 a single follower roller 88 engageable with the central low lift cam 89 and rotatably carried on bearings, such as needles not shown, which ride on an axle pin 90. The pin 90 is received in a transverse bore 91 in the piston extended portion. The pin 90 may be press fitted, staked or otherwise held fixed in the bore 91 in spaced relation with the pins 84. If desired, the rollers could be journaled directly on bronze pins or have other suitable bearings instead of the needle bearings referred to.

In operation, because of the use of roller followers 75, 76 suitable alignment means are needed to prevent rotation about their reciprocation axis 94. Obviously, the rotator bearing 40 of the first embodiment is no longer needed. For the outer follower 75, the outer ends 95 of the axle pins 84 may extend beyond the body 78 into mating grooves 96 provided in the associated bore 98 of the engine block 99. Then means, as shown, such as pin 71 and groove 72 similar to the first embodiment may be used to prevent relative rotation of the inner and outer cam followers 75, 76. Thus, the rollers 80, 88 are maintained square with the axis of the camshaft 83 and ride properly on their respective cams 82, 89. In other respects, the FIG. 4 embodiment operates in the same manner as that first described. However, instead of the extended axle pins 84, alternative alignment means, such as those of FIGS. 10 and 11 might equally well be used.

FIGS. 4*a* and 4*b* illustrate some variations of the second embodiment in the manner of aligning the inner and outer cam followers. In FIG. 4*a*, the axle pins 84*a* have reduced diameter inner ends that extend beyond the inner surface 39 of the body 78 into grooves 72*a* formed in the modified piston 86*a* to maintain alignment of the followers. The central roller axle pin 90*a* is held in openings in the piston 86*a*.

In the variation of FIG. 4*b*, flat inner ends of the axle pins 84*b* extend inward of the inner surface 39 and engage flats 72*b* on the modified piston 86*b* to maintain follower alignment. The central roller axle pin 90*b* is again retained in openings in the piston 86*b*.

Third Embodiment—RVDAH

FIGS. 5–7 with added subletter views illustrate variations of still another embodiment of the invention wherein a two step variable lift valve mechanism is provided in an overhead cam engine having direct acting cam followers. As shown in FIG. 5, the engine 100 includes a block, head and/or carrier component 102 supporting a camshaft 103 and a plurality of roller variable direct acting hydraulic valve lifters (RVDAH) 104*c*, only one being shown. The camshaft 103 includes a pair of spaced high lift cams 106 and a central low lift cam 107 for each of the inlet valves 108 and/or exhaust valves of the engine that are actuated by an RVDAH lifter. In the engine shown, each lifter 104*c* has a high lift outer cam follower 110 associated with the high lift cams 106 and a low lift inner cam follower 111 associated with the low lift cams.

Detailed construction of the lifter is best shown in the variation of valve lifter 104 illustrated in FIGS. 5*a*, 5*b*, 6 and 7. The outer follower 110 has an annular body 112 with a cylindrical outer surface 114 that is reciprocable in a sleeve or bore 115 in the engine cam carrier or other component 102. The outer surface 114 extends along an upper portion or head 116 of the body and an adjoining depending skirt 117 portion. The head 116 also has a cylindrical inner surface 118 spaced concentrically within the outer surface and terminates downward in a radial abutment or shoulder 119.

Between the inner and outer surfaces 114, 118, are laterally spaced recesses or pockets 120 in which rollers 122 are located. The rollers 122 engage the cams 106 and are rotatably carried by suitable bearing means supported on axle pins 124, 124' held by locator pins 125 in transverse openings of the follower head 116. Preferably, one of the pins 124' has an outer end 126 that extends outward of the outer surface 114 into a mating groove 127 of the associated bore 115. This prevents rotation of the follower and maintains the rollers in alignment with their respective cams 106.

The inner follower 111 comprises a hollow cylinder 130 having a closed end 131 and a depending cylindrical outer wall 132 open at the other end. The closed end 131 is engageable with the central low lift cam 107 to follow its lift curve. The outer wall 132 is received in the cylindrical inner surface 118 of the outer follower 110 for reciprocation on a common axis 134. Grooves or flats 135 are engaged by inner ends 136 of the pins 124, 124' which extend inwardly beyond the inner surface 118 of the outer follower to prevent relative rotation of the followers.

Within the follower cylinder 130, there is received a small hydraulic lash adjuster or hydraulic element assembly (HEA) 138. This HEA includes a hollow piston 139 internally carrying a plunger 140 with a check valve 141 and other elements similar to conventional HEA's although of smaller size in preferred embodiments. Elements 50–52 of FIG. 3 are of generally similar character and function. A groove 142 may be provided on the plunger 140 to control oil leakage from the piston. The piston 139 directly engages the stem of the valve 108 for actuating it in an opening direction. A valve spring 143 acting against the valve and a fixed seat, not shown, in the engine biases the valve 108 in a closing direction. A concentric outer spring 144, acting between the shoulder 119 and a fixed seat, not shown, similarly biases the rollers of the outer follower 110 against the high lift cams 106.

An annular or arcuate groove 145 around the outer surface 114 of the body 112 receives oil from a gallery 146 in the component 102 and carries it through oil passages 147, 148 in the body 112 and cylinder 130 to deliver oil from the groove 145 to the interior of the cylinder for supplying oil to the lash adjuster (HEA).

Lock pins 150 carried in the body 112 of the outer follower are open to the groove 145. They cooperate with elements similar to openings 64, springs 67, retaining pins 68 and flats 70 of FIG. 3 to lock the inner and outer followers 110, 111 together or release them in the manner described with regard to the FIG. 3 embodiment. Oil pressure may be controlled in the manner described for that embodiment.

FIGS. 6*a* and 7*a* show a variation of the third RVDAH embodiment wherein the inner ends 136*a* of the axle pins 124, 124' are of reduced diameter to extend into grooves 135*a* of relatively narrow width in the modified cylinder 130*a*. This provides an alternate manner of maintaining alignment of the inner and outer followers. A comparable variation is shown in the lifter 104*c* of FIG. 5 where the outer ends of the axle pins are of reduced diameter and engage narrower grooves in the sleeve 115 to prevent rotation of the lifter in its bore. Other arrangements, such as that of FIGS. 10 and 11 can be used as alternatives.

FIGS. 6*b* and 7*b* show another variation, similar to that of FIG. 2, wherein a guide pin 71*b* carried in the modified body 112*b* extends into a narrow groove 72*b* in the cylinder 130*b* to maintain alignment of the followers.

In operation, camshaft rotation causes the high lift cams 106 to actuate the outer follower on a full or high lift curve while the low lift cam 107 selectively actuates the inner follower 111 on a partial or low lift curve as determined by the cam profiles. When the oil pressure is controlled at a low level, the lock pins 150 are not engaged, as is shown in FIG. 7, and the valve is moved through the low lift curve by the low lift cam acting on the inner follower 111 while the outer cam follower 110 idles. When oil pressure is raised above a preset level, the lock pins 150 are actuated to lock the inner and outer followers together so that the high lift cams 106 control valve motion to follow the high lift curve through the interconnected followers 110, 111.

The rollers 122 on the outer follower 110 are effective to reduce the friction of the valve mechanism during operation on the high lift curve and also during low lift operation when the outer follower 110 is moved in a high lift idling motion against the bias of the outer return spring 144. While it would be possible to also provide a roller on the inner follower 111 to further reduce friction loss, this would require an increase in the size and mass of the inner follower which may not be acceptable. Instead, the FIGS. 5–7 embodiment allows the HEA 138 lash adjuster to be located between the rollers to provide a compact and relatively low mass assembly. Since the friction created on the low lift valve curve by the cam 107 moving the lighter low lift follower 111 only against the valve spring 143 is relatively low, this provides a preferable compact and efficient design for use in many overhead cam direct acting valve gear applications.

Fourth Embodiment—RDAH

Turning now to FIGS. 8 and 9, another embodiment is illustrated which is based upon the RVDAH of FIGS. 5–7 but is simplified for operation as a single step non-variable lift valve mechanism. Like reference numerals are again used for like parts. The engine arrangement is similar to that of FIG. 5 wherein an engine component 102 supports a camshaft 103 and provides a sleeve or bore 115 having a guide groove 127 and communicating with an oil pressure gallery 146. At least one inlet valve 108 is provided for each cylinder of the engine as are exhaust valves, not shown. A spring 143 biases the valve 108 toward closing. Central cam 107, cylinder 130 and return spring 144 are omitted.

The camshaft carries only two spaced cams 106 which are configured to actuate the valve over the full non-variable lift curve. The cams engage spaced rollers 122 carried by suitable bearing means on axle pins 124, 124' fixed by locator pins 125 in a cup-like body 152 of a cam follower 154. The extended outer end 126 of pin 124 engages a groove 127 to prevent rotation of the follower 154.

The follower body 152, includes a skirt 155 depending from a head 156 carrying the rollers 122. Between the rollers, the head defines a cylinder 158 closed at the top in which a lash adjusting HEA 138 is received. The HEA directly engages the stem of a valve 108 and receives oil through an oil passage 159 extending into the body to the cylinder 158 near the closed end. The HEA 138 together with the follower 154 including the body 152 and rollers 122 form an assembly comprising a roller direct acting hydraulic valve lifter (RDAH) 160.

In operation, the cams 106 actuate the rollers to move the valve lifter 160 and the valve 108 in a preset lift curve. The arrangement provides a compact construction for a direct acting valve lifter having friction reducing rollers by reason of the split cams 106 actuating dual rollers 122 with the HEA 138 located between the rollers. With this arrangement and proper sizing of the lifter 160 and its HEA 122, the distance between the camshaft and the end of the valve stem can be reduced to little or no more than is occupied by currently available non-roller direct acting hydraulic valve lifters.

Anti-Rotation Variation

FIGS. 10 and 11 show another variation of lifter anti-rotation device which is applicable to any of the embodiments previously shown where nonrotation is desired. In this case, it is shown as a variation 104' of the RVDAH lifter embodiment of FIGS. 5*a*, 5*b*, 6 and 7.

This RVDAH lifter 104' deletes the long pin 124' and mating groove 127 of the RVDAH 104 and instead uses two identical axle pins 124 which do not extend beyond the body 112'. Rotation is prevented by a steel anti-rotation pin 162 which extends into two half round mating slots 163, 164 in the body 112' and its supporting component 102' respectively. The pin 162 is preferably fixed to the component 102' such as through a tab 166 which is secured to the outer end of the pin 162. This assembly is then attached to the component 102' such as by a screw 167 holding the tab in place. Any other suitable retention means might also be applied.

This anti-rotation device has the advantage, when the support component 102' is aluminum or the like, that the reciprocating friction and wear is between the harder steel elements of the body 112' and the pin 162. In this way, wear or abrasion of the aluminum material is avoided. Also, the slot 163 can be limited in length to the thick head portion of the body since the pin 162 is installed after the lifter 104' has been assembled into its associated bore.

While the invention has been described by reference to certain preferred and alternative embodiments and variations, it should be understood that numerous additional changes could be made within the spirit and scope of the inventive concepts described. For example, solid tappets or other lash adjusters could replace the HEAs. Also, lifters according to the invention may be applied to all or less than all of the intake and/or exhaust valves of the engine. Accordingly it is intended that the invention not be limited to the disclosed embodiments, but that it have the full scope permitted by the language of the following claims.

What is claimed is:

1. A two step valve lifter comprising an outer cam follower including an annular cylindrical body with first and second annular ends and concentric inner and outer cylinder surfaces, the first annular end including a pair of laterally spaced first cam engaging portions comprising a pair of rollers, an inner cam follower including a hollow piston with at least one closed end, a second end and a cylindrical outer wall reciprocably engaging the inner cylinder surface of said body, the closed end including a second cam engaging portion located generally between said first cam engaging portions, locking means on the outer and inner cam followers and engageable for selectively locking the followers together for coincident reciprocating motion, the hollow piston forming a part of hydraulic lash adjusting means including a plunger reciprocable in the piston and carrying check valve means, the plunger defining with the piston a high pressure chamber adjacent the piston closed end and an inner reservoir in the plunger extending from the check valve means toward the piston second end, and means for delivering oil through the outer and inner followers to the reservoir distal from the piston closed end and the check valve means.

2. A two step valve lifter as in claim 1 wherein said second cam engaging portion comprises a third roller.

3. A two step valve lifter as in claim 1 and further including guide means associated with the body and cooperable with alignment means external to the lifter to prevent rotation of the body relative to external support means.

4. A two step valve lifter as in claim 3 wherein the guide means comprise a groove of part-cylindrical cross section recessed in the outer cylinder surface of the body and extending axially from one of the annular ends.

5. A two step valve lifter as in claim 1 wherein the rollers are mounted on shafts having outer ends extending beyond the cylindrical outer surface of the body for engagement with alignment means of associated support means for cooperating with the shaft ends to prevent rotation of the body relative to the support means.

6. A two step valve lifter as in claim 1 wherein the body rollers are mounted on shafts having inner ends extending beyond the cylindrical inner surface of the body for engagement with associated means of the hollow piston, the shaft ends and the associated means comprising said alignment means to prevent rotation of the body relative to the piston.

7. A two step valve lifter as in claim 6 wherein the shafts have outer ends extending beyond the cylindrical outer surface of the body for engagement with alignment means of associated support means for cooperating with the shaft ends to prevent rotation of the body relative to the support means.

* * * * *